United States Patent [19]

Hasebe et al.

[11] Patent Number: 4,909,195

[45] Date of Patent: Mar. 20, 1990

[54] VALVE OPERATING SYSTEM OF INTERNAL COMBUSTION ENGINE

[75] Inventors: Hiroshi Hasebe; Yoshio Nuiya, both of Saitama, Japan

[73] Assignee: Honda Giken Kogyo Kabushiki Kaisha, Tokyo, Japan

[21] Appl. No.: 383,188

[22] Filed: Jul. 20, 1989

[30] Foreign Application Priority Data

Oct. 11, 1988 [JP] Japan ..... 63-255625

[51] Int. Cl.[4] ..... F01L 1/34

[52] U.S. Cl. ..... 123/90.16; 123/90.44

[58] Field of Search ..... 123/90.12, 90.15, 90.16, 123/90.17, 90.44, 198 F, 137

[56] References Cited

U.S. PATENT DOCUMENTS 4,537,165 8/1985 Honda et al. ..... 123/90.16
4,611,558 9/1986 Yoshizaki et al. ..... 123/198 F
4,656,977 4/1987 Nagahiro et al. ..... 123/90.16
4,727,831 3/1988 Nagahiro et al. ..... 123/90.16
4,790,274 12/1988 Inoue et al. ..... 123/90.16

FOREIGN PATENT DOCUMENTS 63-124817 5/1988 Japan .

*Primary Examiner*—Charles J. Myhre
*Assistant Examiner*—Weilun Lo
*Attorney, Agent, or Firm*—Lyon & Lyon

[57] ABSTRACT

For switching over the operation mode of at least one engine valve, a connection means or a switchover pin is disposed to connect a plurality of valve operating means or rocker arms integrally or release such connection and a detection means is disposed to detect a moved position of the connection means or switchover pin. Thereby, it is checked whether the operation mode of the engine valve is in conformance with the connected state or the connection released state of the valve operating means, and therefore an operationally locked condition of the connection means or the switchover pin is detected, for example.

7 Claims, 11 Drawing Sheets

VALVE OPERATING SYSTEM OF INTERNAL COMBUSTION ENGINE

BACKGROUND OF THE INVENTION

1. FIELD OF THE INVENTION

The field of the invention is a valve operating system of an internal combustion engine, which has a plurality of valve operating means disposed for opening and closing engine valves, a connection means movable for integrally connecting the valve operating means, and a driving means for driving said connection means.

2. DESCRIPTION OF THE PRIOR ART

Valve operating systems of the above mentioned type are known, for example, from Japanese Patent Publication Kokai No. 124817/88 and the like.

In case of such a known valve operating system, a connection switchover mechanism for selectively connecting and releasing connection between a plurality of rocker arms as the afore-mentioned valve operating means is provided and it comprises a plurality of pins which are abutted against each other in coaxial arrangement, the pins including a switchover pin exposed at one axial end surface thereof to a hydraulic pressure chamber and movable between a position connecting adjacent rocker arms and another position releasing such connection and a regulating pin with a return spring interposed between the regulating pin and one rocker arm, the return spring exerting a spring force to the regulating pin so as to urge it toward the one axial end side.

In such a valve operating system, however, the connection switchover mechanism may encounter a problem that the switchover pin is locked against movement and therefore it is desired to detect and deal with such an operationally locked condition of the connection switchover mechanism. Formerly proposed systems, however, do not have means for detecting a locked condition of the connection switchover mechanism.

SUMMARY OF THE INVENTION

The present invention has been proposed in view of the afore-mentioned circumstances and one object thereof is to provide a valve operating system of an internal combustion engine wherein any operational locked condition of the afore-mentioned connection means can be detected by an extremely simple structure.

In order to achieve the above object, the present invention provides a detection means for detecting a moved position of the connection means.

Further, according to the invention, the regulating pin of the connection switchover mechanism is provided with a shaft portion extending through one rocker arm on which the regulating pin is disposed and a detection means is provided on the rocker arm for detecting the axial position of the shaft portion.

The above arrangements permit the displaced position of the connection means or the shaft portion of regulating pin to be detected by an extremely simple structure and therefore an erroneous operation of the connection means can be detected.

BRIEF DESCRIPTION OF THE DRAWINGS

The drawings show one embodiment according to the present invention, wherein.

DESCRIPTION OF THE PREFERRED EMBODIMENT

One embodiment according to the present invention will be described hereinafter with reference to the accompanying drawings.

Figure 1:
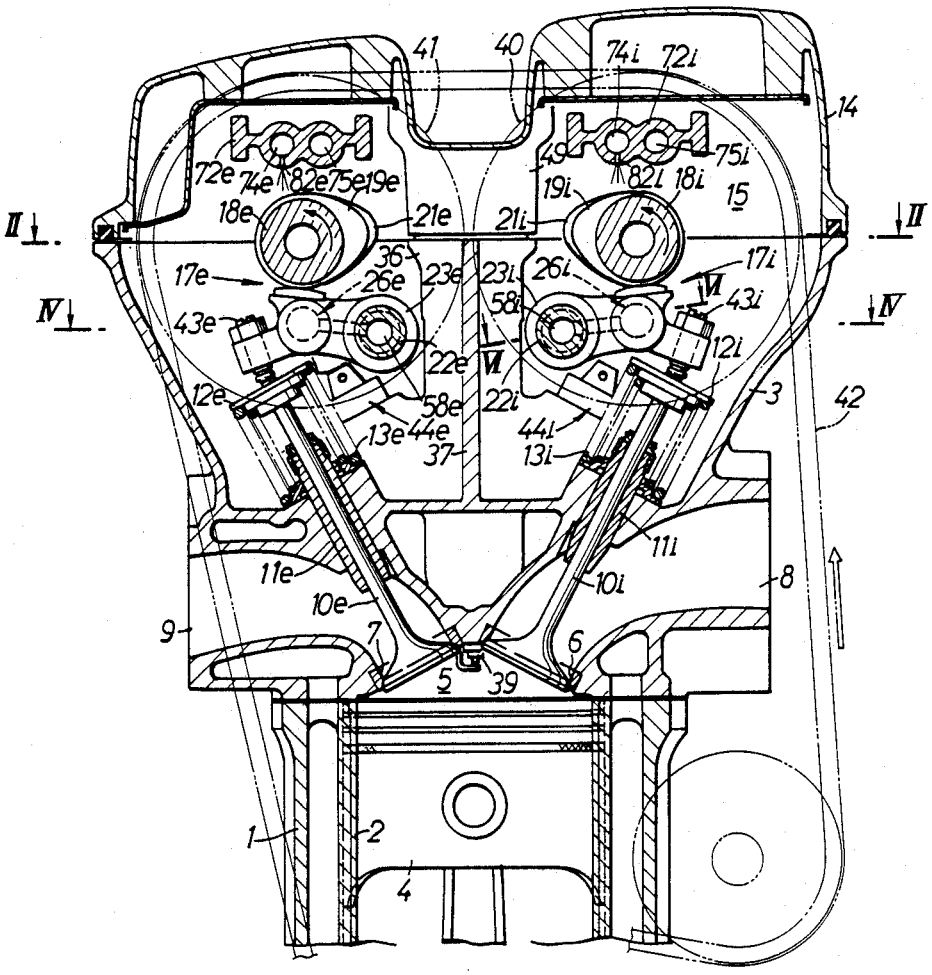
FIG. 1 is a longitudinal sectional view of an essential portion of an internal combustion engine, taken along the line I—I of FIG. 2.
Figure 2:
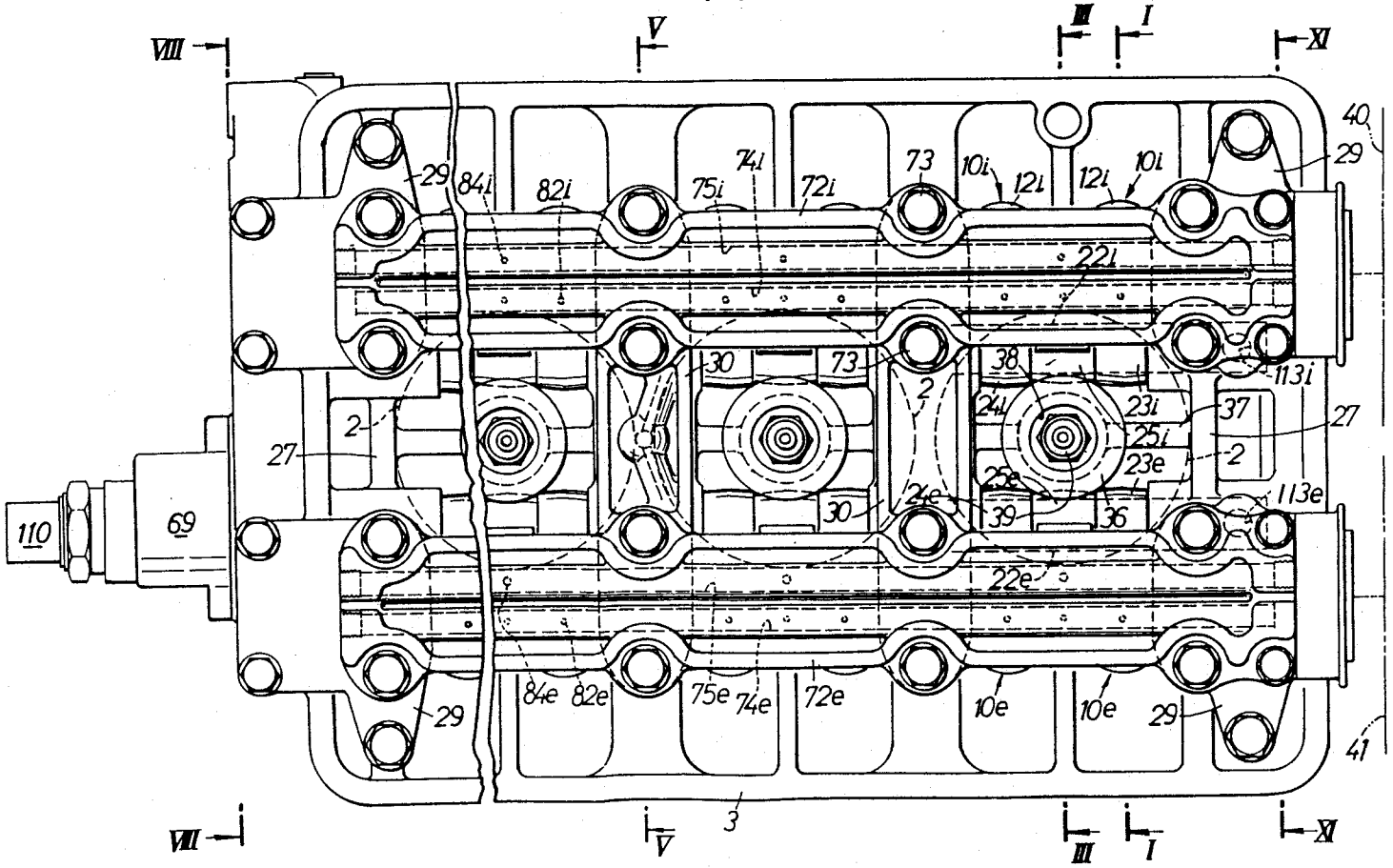
FIG. 2 is a view seen in the direction of the line II—II of FIG. 1.

First referring to FIGS. 1 and 2, a DOHC multi-cylinder type internal combustion engine to be mounted on a vehicle is shown to have in a cylinder block 1 four cylinders 2 which are arranged straightforwardly. A cylinder head 3 is joined to the upper end of the cylinder block 1 and a piston 4 is slidably fitted into each cylinder 2 to define a combustion chamber 5 between the piston 4 and the cylinder head 3. At each of those portions of the cylinder head 3 which form ceiling surfaces of the respective combustion chambers 5, a pair of intake openings 6 and a pair of exhaust openings 7 are provided. Each intake opening 6 is connected to an intake port 8 which opens to one side surface of the cylinder head 3 whereas each exhaust opening 7 is connected to an exhaust port 9 opening to the other side surface of the cylinder head 3.

Guide sleeves **11*i* and 11*e* are fitted in and held in place on the cylinder head 3 at portions thereof corresponding to respective cylinders 2 for guiding intake valves 10*i* as a pair of engine valves capable of opening and closing the intake openings 6 and for guiding exhaust valves 10*e* serving as a pair of engine valves capable of opening and closing the exhaust openings 7 for each cylinder 2. The intake valves 10*i* and the exhaust valves 10*e* have their stem ends projected upwardly from the guide sleeves 11*i* and 11*e* and flange portions 12*i* and 12*e* are disposed on the stem ends of the valves. Valve springs 13*i* and 13*e* are mounted in compression between the flange portions 12*i*, 12*e* and the cylinder head 3 and these springs serve to urge the respective intake valves 10*i* and exhaust valves 10*e*** in an upward or valve-closing direction.

A head cover 14 is joined to the upper end of the cylinder head 3 to define therebetween an operation chamber 15 which is used to accommodate therein an intake valve side valve operating system **17*i* for drivingly opening and closing the intake valves 10*i* of each cylinder 2 and an exhaust valve side valve operating system 17*e* for drivingly opening and closing the exhaust valves 10*e* of each cylinder 2. Both the valve operating systems 17*i* and 17*e* basically have the same structure as each other so that the intake valve side valve operating system 17*i* will be described below with affix "i" being attached to reference numerals for the elements thereof and the exhaust valve side valve operating system 17*e*** will be illustrated only with affix "e" attached to reference numerals for its associated elements and description of the latter will be omitted here.

Figure 3:
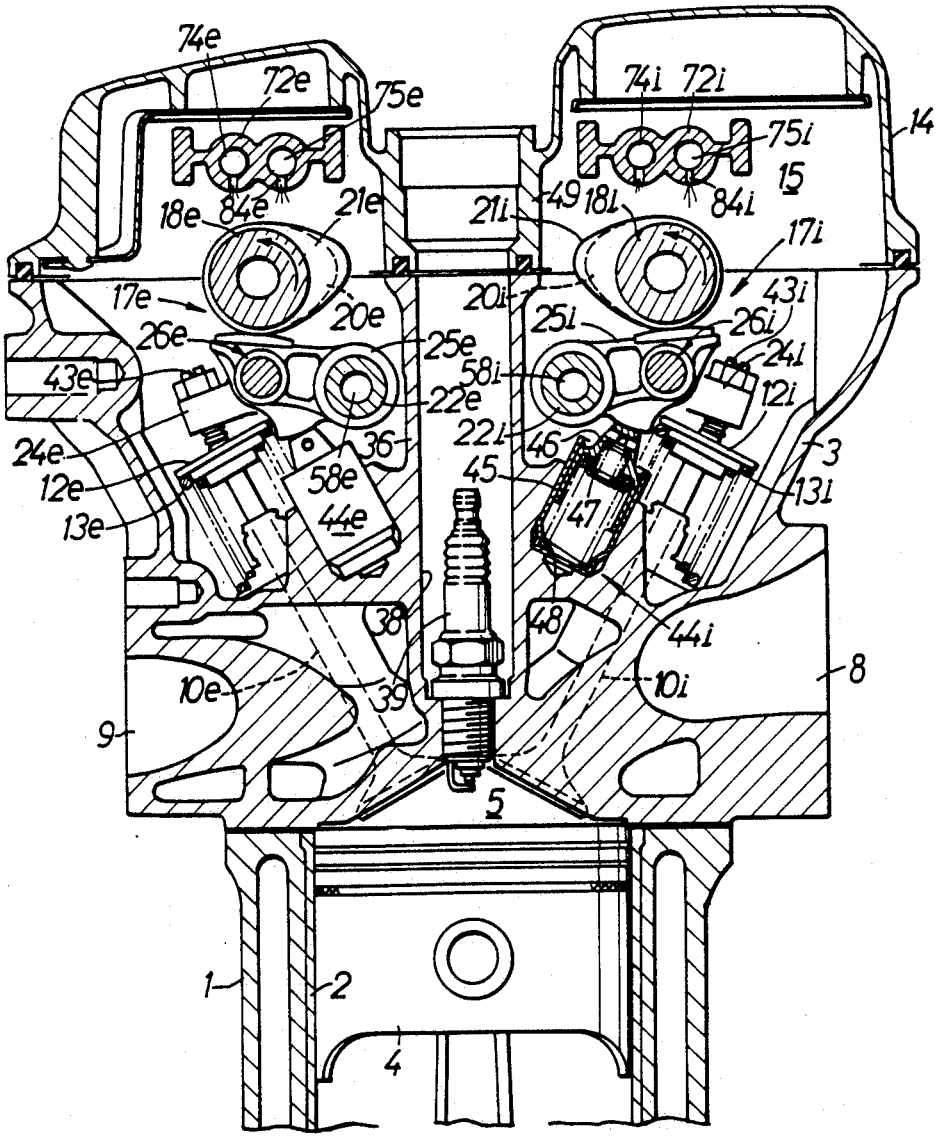
FIG. 3 is a sectional view taken along the line III—III of FIG. 2.
Figure 4:
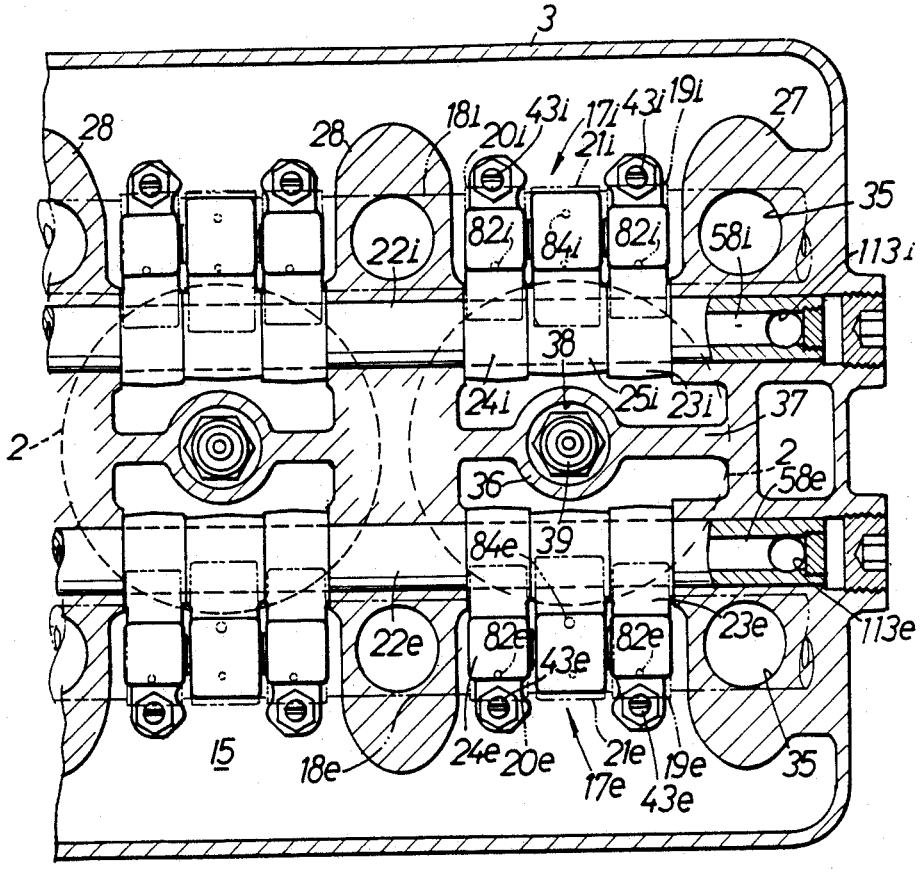
FIG. 4 is a sectional view taken along the line IV—IV of FIG. 1.

Referring also to FIGS. 3 and 4, the intake valve side valve operating system **17*i* comprises a camshaft 18*i* which is driven for rotation at a reduction ratio of ½ from a crankshaft, not shown, of the engine; low speed cams 19*i*, 20*i* and a high speed cam 21*i* disposed on the camshaft 18*i* correspondingly to each cylinder 2; a rocker shaft 22*i* located in parallel to the camshaft 18*i*; a first drive rocker arm 23*i*, a second drive rocker arm 24*i* and a free rocker arm 25*i* which serve as valve operating means and are pivotable around the rocker shaft 22*i* and disposed in correspondence to each cylinder 2; and a hydraulically operated connection switchover mechanism 26*i* disposed over the rocker arms 23*i*, 24*i* and 25*i* for each cylinder 2**.

Figure 5:
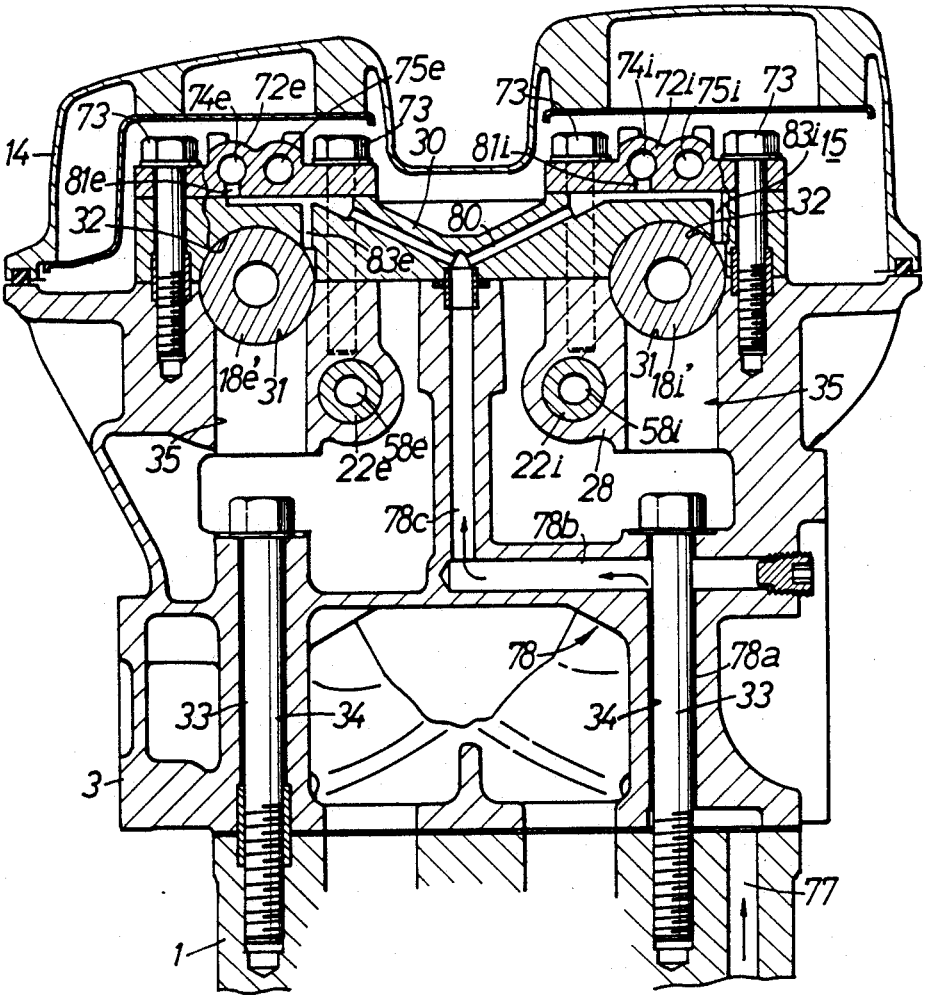
FIG. 5 is a sectional view taken along the line V—V of FIG. 2.

Additionally referring to FIG. 5, the camshaft **18*i* is disposed rotatably around the axis thereof and extends parallel to the array of the cylinders 2 at an upper position of the cylinder head 3. More specifically, the cylinder head 3 is integrally formed with cam support portions 27, 27 on opposite ends thereof in the direction of arrangement of the cylinders 2 and further with three cam support portions 28 . . . at locations between the respective cylinders 2. Cam holders 29, 29 are mounted by tightening onto the cam support portions 27, 27 on the opposite ends and cam holders 30 . . . are mounted by tightening onto the three cam support portions 28 . . . , respectively, thus holding the camshaft 18*i* in rotatable fashion around its axis between these cam support portions and cam holders. Moreover, each cam holder 29 is provided independently for each of the intake valve side valve operating system 17*i* and the exhaust valve side valve operating system 17*e* whereas each cam holder 30 is provided for common use with both the valve operating systems 17*i*, 17*e*. A semi-circular support surface 31 is formed on the upper surface of each of the cam support portions 27, 27 and 28 . . . for supporting the lower half outer peripheral surface of the camshaft 18*i*, 18*e* and a semi-circular support surface 32 is formed on the lower surface of each of the cam holders 29 and 30 to support the upper half outer peripheral surface of the camshaft 18*i*, 18*e***.

In each of the cam support portions 27, 27 and 28 . . . , there are provided a pair of vertical insertion holes 34 correspondingly to the camshafts **18*i*, 18*e* for insertion of bolts 33 which serve to tighten the cylinder head 3 onto the cylinder block 1 and there are further provided, at upper positions aligned with the insertion holes 34, vertically extending operation holes 35 which open at upper ends thereof to the semi-circular support surfaces 31 for admitting the operation of rotating the bolts 33** therethrough.

A vertically extending, cylindrical central block 36 is integrally formed on the cylinder block 3 at each of locations between the cam support portions 27, 27 and 28 . . . and centrally in the widthwise direction of each cylinder 2. This central block 36 is connected to its adjacent cam support portions 27, 27 and 28 . . . at opposite sides thereof via support walls 37. The head cover 14 is provided with a cylindrical central block 49 to be connected to the central block 36. A plug fitting hole 38 is defined through the central blocks 36 and 49 and an ignition plug 39 is mounted in this plug fitting hole 38 so as to project into the combustion chamber 5.

One ends of both the camshafts **18*i* and 18*e* are projected outside of the cylinder head 3 and head cover 14 and are fixed thereon with timing pulleys 40 and 41 around which a timing belt 42 is wrapped for transmitting a driving force to the pulleys from the crankshaft, not shown. This arrangement makes the camshafts 18*i* and 18*e*** rotate in the same direction.

The camshaft **18*i* is integrally formed with low speed cams 19*i* and 20*i* at positions corresponding to the respective intake valves 10*i* and also with a high speed cam 21*i* between both the low speed cams 19*i* and 20*i*. On the other hand, the rocker shaft 22*i* is fixedly held on the cam support portions 27, 27 and 28 . . . with its axis parallel to the camshaft 18*i* below the latter. On this rocker shaft 22*i* are pivoted a first drive rocker arm 23*i* operatively connected to one intake valve 10*i*, a second drive rocker arm 24*i* operatively connected to the other intake valve 10*i* and a free rocker arm 25*i* disposed between the first and second drive rocker arms 23*i* and 24*i***, these rocker arms being disposed adjacent to each other.

A tappet screw **43*i* is threadedly engaged in each of the first and second drive rocker arms 23*i* and 24*i* for advanced and retracted movements thereto and these tappet screws 43*i* are placed in abutment against the stem ends of the corresponding intake valves 10*i*, thus bringing the drive rocker arms 23*i*, 24*i* in operative connection with the intake valves 10*i***, respectively.

The free rocker arm **25*i* is resiliently urged by a lost motion mechanism 44*i* interposed between the arm 25*i* and the cylinder head 3*i* a direction coming into slide contact with the high speed cam 21*i*, as shown in FIG. 3. The lost motion mechanism 44*i* comprises a bottomed, cylindrical guide member 45 fitted at its closed end to the cylinder head 3, a piston 46 slidably fitted into the guide member 45 and abutting against a lower surface of the free rocker arm 25*i*, and first and second springs 47 and 48 interposed in series between the piston 46 and the guide member 45 to urge the piston 46 toward the free rocker arm 25. The spring constants of first and second springs 47 and 48** are set differently from each other.

Figure 6:
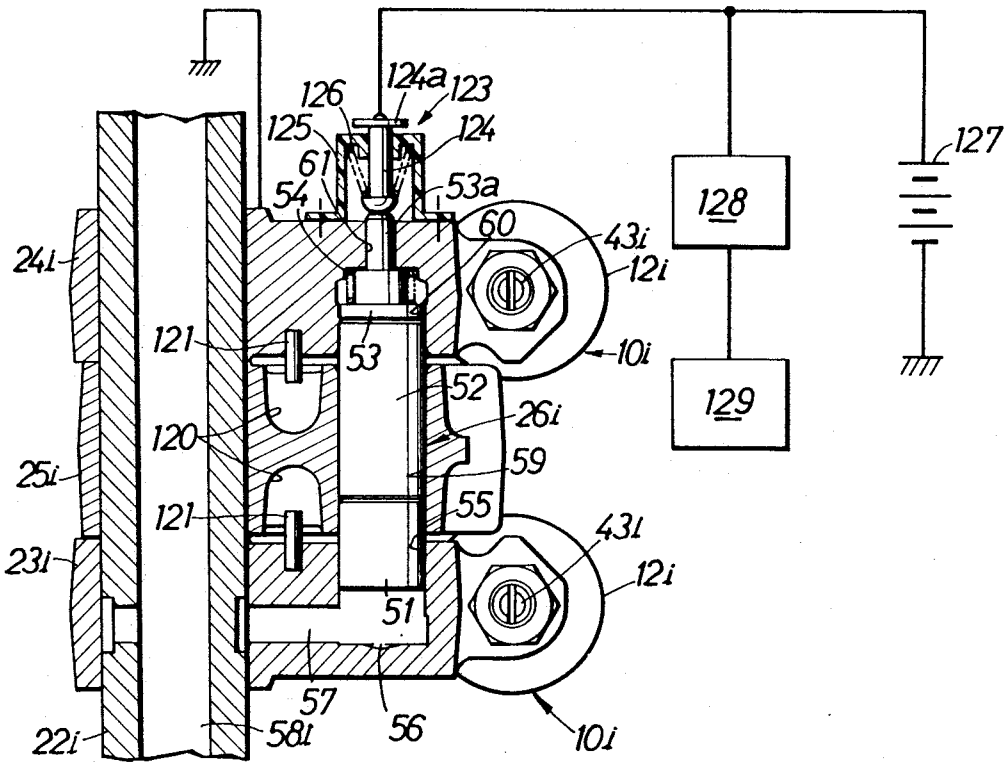
FIG. 6 is an enlarged sectional view taken along the line VI—VI of FIG. 1.

In FIG. 6, the connection switchover mechanism **26*i* comprises a first switchover pin 51 as a connection means capable of connecting the first drive rocker arm 23*i* and the free rocker arm 25*i*, a second switchover pin 52 as a connection means capable of connecting the free rocker arm 25*i* and the second drive rocker arm 24*i*, a regulating pin 53 for regulating shifting movements of the first and second switchover pins 51 and 52, and a return spring 54 which urges the pins 51, 52 and 53** toward the side releasing the connection between the rocker arms.

The first drive rocker arm **23*i* is formed with a bottomed, first guide bore 55 which opens toward the free rocker arm 25*i* and extends parallel to the camshaft 22*i*. The first switchover pin 51 has a cylindrical shape and is slidably fitted into the first guide bore 55 to define a hydraulic pressure chamber 56 between one end of the first switchover pin 51 and the closed end of the first guide bore 55. Hydraulic pressure as a driving means is introduced into the hydraulic pressure chamber 56 for urging the first and second switchover pins 51 and 52 in order to connect the rocker arms 23*i*, 24*i* and 25*i* together, when desired. The first drive rocker arm 23*i* is further bored with a passage 57 communicating with the hydraulic pressure chamber 56 and the rocker shaft 22*i* is formed therein with an oil supply passage 58*i* which is always in communication with the hydraulic pressure chamber 56 via the passage 57 irrespective of the swung position of the first drive rocker arm 23*i***.

The free rocker arm **25*i* is formed with a guide hole 59 extending in alignment with the first guide bore 55** and in parallel to the rocker shaft 22*i* over opposite side surfaces of the free rocker arm 25*i*. The second switchover pin 52 is slidably fitted in the guide hole 59 while having one end thereof abutted against the other end of the first switchover pin 51. The second switchover pin 52 also has a cylindrical shape.

The second drive rocker arm 24*i* is formed with a bottomed, second guide bore 60 which extends in alignment with the guide hole 59 and in parallel to the rocker shaft 22*i* and opens toward the free rocker arm 25*i*. The regulating pin 53 of a disc shape is slidably fitted in this second guide bore 60 while abutting against the other end of the second switchover pin 52. The return spring 54 is interposed under compression between the closed end of the second guide bore 60 and the regulating pin 53 and its spring force acts on the mutually abutted pins 51, 52 and 53 to urge them toward the hydraulic pressure chamber 56. At the closed end of the second guide bore 60 there is further formed a hole 61 coaxial with the guide bore 60 and a shaft portion 53*a* which is coaxially provided on the regulating pin 53 extends trough the hole 61.

When the hydraulic pressure in the chamber 56 rises to a high level in this connection switchover mechanism 26*i*, the first switchover pin 51 moves into the guide hole 59 and the second switchover pin 52 moves into the second guide bore 60 thereby connecting the rocker arms 23*i*, 25*i* and 24*i* together and in this state the shaft portion 53*a* projects outside of the hole 61. In case the hydraulic pressure within the chamber 56 is reduced, the first switchover pin 51 returns with the aid of the force of the return spring 54 to a position at which the end surface of the pin 51 abutting against the second switchover pin 52 is located between the first drive rocker arm 23*i* and the free rocker arm 25*i* and the end surface of the second switchover pin 52 abutting against the regulating pin 52 is located between the free rocker arm 25*i* and the second drive rocker arm 24*i*. At this position the connection between the rocker arms 23*i*, 25*i* and 24*i* is released and the shaft portion 53*a* is retracted into the hole 61.

The free rocker arm 25*i* is provided with recesses 120, 120 at side faces thereof opposed to the first and second drive rocker arms 23*i* and 24*i* in order to reduce weight whereas to the side faces of the first and second drive rocker arms 23*i* and 24*i* opposed to the respective recesses 120 and 120, spring pins 121 are secured by press fit so as to extend into the opposed recesses 120, 120. These recesses 120, 120 and spring pins 121, 12 cooperate together to regulate relative rocking movements between the free rocker arm 25*i* and the first and second drive rocker arms 23*i*, 24*i*. It should be noted here that the first and second drive rocker arms 23*i*, 24*i* which are in slidable contact with the low speed cams 19*i*, 20*i* and the free rocker arm 25*i* which is in slidable contact with the high speed cam 21*i* perform rocking movements relative to each other during low speed operation of the engine and therefore the recesses 120, 120 are formed so as not to disturb such relative rocking movements. Moreover, these recesses 120 and spring pins 121 serve to prevent the rocker arms 23*i*, 24*i* and 25*i* from rocking unlimitedly relative to each other at the time of disassembly for maintenance, thereby preventing fall off of the first and second switchover pins 51 and 52 and the like inconveniences.

A detection means 123 is mounted to the second drive rocker arm 24*i* for detecting the axial position of the shaft portion 53*a* of the afore-mentioned regulating pin 53. This detection means 123 comprises a detection pin 124 opposed coaxially to the tip end of the shaft portion 53*a*, a support member 125 secured to one side face of the second drive rocker arm 24*i* or supporting the detection pin 124 thereon for axial displacement and a spring 126 compressed between the detection pin 124 and the support member 125 for urging the pin 124 toward the shaft portion 53*a*. One end of the detection pin 124 is projected outside of the support member 125 and is equipped with a regulating flange 124*a* which serves to regulate displacement of the detection pin 124 toward the shaft portion 53*a* by abutting against the support member 125. When the connection switchover mechanism 26*i* is in a connection release condition with the shaft portion 53*a* having been retracted inwardly of the hole 61, the detection pin 124 is not in abutment against the shaft portion 53*a* nor against the second drive rocker arm 24*i*.

In the detection means 123, the detection pin 124 is formed of a conductive material and the support member 125 is formed of a non-conductive material such as synthetic resin. On the other hand, at lest the regulating pin 53 and the second drive rocker arm 24*i* are made of conductive materials and the second drive rocker arm 24*i* is grounded. The detection pin 124 is connected to an electrical power supply 127 and a control circuit 128 is connected between the detection pin 124 and the power supply 127. When the detection pin 124 comes into abutment against the shaft portion 53*a*, a low level of voltage is inputted to the control circuit 128 whereas when the detection pin 124 is out of abutment against the shaft portion 53*a*, a high level of voltage is inputted to the circuit 128. Moreover, an alarm means 129 such as an alarm lamp is connected to the control circuit 128 and this alarm means 129 is actuated by the control circuit 128 when a low voltage is fed to the circuit 128 indicative of a state that the connection switchover mechanism 26*i* is in a connection establishing condition.

Figure 7:
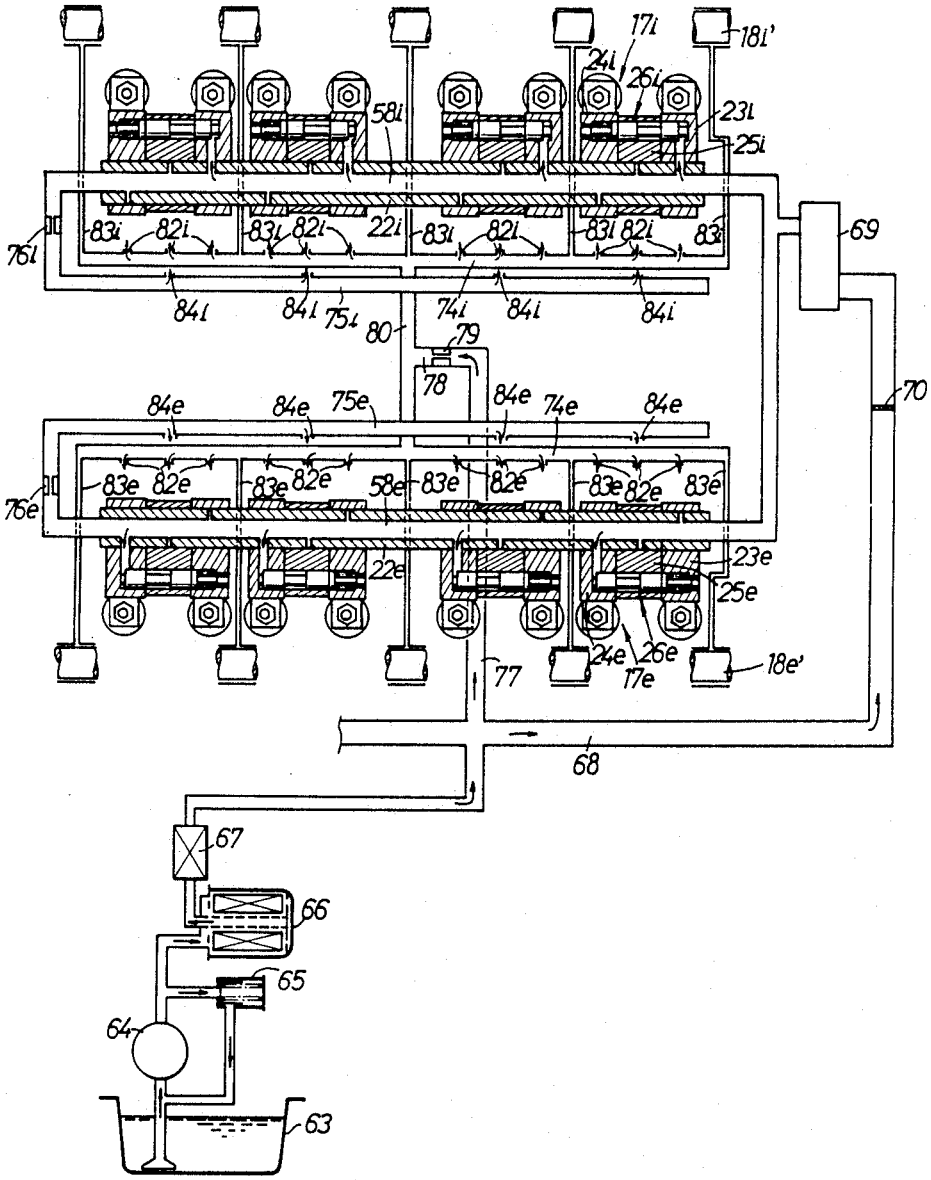
FIG. 7 is a view illustrating oil supply lines.

Next, an oil supply system for the valve operating systems 17*i* and 17*e* will be described with reference to FIG. 7. An oil pump 64 is provided to pump up oil from an oil pan 63 and its outlet is connected to an oil gallery 68 through a relief valve 65, an oil filter 66 and an oil cooler 67 and pressurized oil is fed through this oil gallery 68 to respective connection switchover mechanisms 26*i*, 26*e* and also lubricating oil is supplied to lubricated parts of the valve operating systems 17*i*, 17*e*.

A switchover valve 69 is connected to the oil gallery 68 for permitting flow of the pressurized oil, which has passed a filter 70 disposed midway of the oil gallery 68, at a high pressure level or a low pressure level in a switched manner. Oil supply passages 58*i* and 58*e* formed within the rocker shafts 22*i* and 22*e* are connected to the oil gallery 68 through the switchover valve 69. Passage defining members 72*i* and 72*e* are tightened to upper surfaces of the cam holders 29, 29 and 30 . . . by a plurality of bolts 73 so as to extend in parallel to the corresponding camshafts 18*i* and 18*e*, respectively. Within the passage defining members 72*i* and 72*e* are arranged side by side low speed lubricating passages 74*i*, 74*e* closed at ends thereof and high speed lubricating passages 75*i*, 75*e* communicating with the oil supply passages 58*i*, 58*e* via throttles 76*i*, 76*e*.

An oil passage 77 having a throttle 79 disposed in the midway thereof is branched off the oil gallery 68 at a location upstream of the filter 70 and extends upwardly within the cylinder block 1, as shown in FIG. 5. This oil passage 77 is moreover located substantially centrally in the cylinder block 1 in the direction of array of the cylinders 2. One cam support portion 28 disposed at a position substantially centrally along the array of the cylinders 2 is provided with a low speed pressurized oil supply passage 78 in communication with the oil passage 77, which passage 78 comprises an annular passage portion 78*a* surrounding one bolt 33, a passage portion 78*b* communicating with an upper end of the passage portion 78*a* and extending to a central position intermediate both the valve operating systems 17*i* and 17*e* and a passage portion 78*c* leading from the passage portion 78*b* to extend upwardly and opening to an upper surface of the cam support portion 28.

Also in one cam holder 30 located substantially centrally in the direction of array of the cylinders there is provided a forked oil passage 80 of almost Y-shape communicated at a lower end thereof with the upper end of the passage portion 78*c* of the low speed pressured oil supply passage 78, this passage 80 being forked toward the respective sides of the valve operating systems 17*i* and 17*e*. The forked upper ends of the oil passage 80 are communicated with the low speed lubricant passages 74*i* and 74*e*, respectively. More specifically, the passage defining members 72*i* and 72*e* are formed with communication ports 81*i* and 81*e* for placing the forked oil passage 80 in communication with the low speed lubricant passages 74*i* and 74*e*.

The low speed lubricant passages 74*i* and 74*e* are used to supply lubricating oil to sliding parts between respective cams 19*i*, 19*e*; 20*i*, 20*e*; 21*i*, 21*e* and respective rocker arms 23*i*, 23*e*; 2*i*, 24*e*; 25*i*, 25*e* and further to the cam journal portions 18*i*', 18*e*' of the camshafts 18*i*, 18*e*. For lubrication, the passage defining members 72*i*, 72*e* are provided at lower surfaces thereof with lubricant injection ports 82*i*, 82*e* communicating with the low speed lubricant passages 74*i*, 74*e* so as to open correspondingly to the low speed cams 19*i*, 19*e*, 20*i*, 20*e* and the high speed cams 21*i*, 21*e*. The cam holders 30 are appropriately formed with lubricant supply passages 83*i*, 83*e* in communication with the low speed lubricant passages 74*i*, 74*e* in order to feed lubricating oil to respective cam journal portions 18*i*', 18*e*' of the camshafts 18*i*, 18*e*.

On the other hand, the high speed lubricant passages 75*i* and 75*e* are used to supply lubricating oil to sliding parts between the high speed cams 21*i*, 21*e* and the free rocker arms 25*i*, 25*e*, and lubricant injection ports 84*i* and 84*e* communicating with the high speed lubricant passages 75*i* and 75*e* are opened at lower surfaces of the passage defining members 72*i* and 72*e* so as to correspond to the high speed cams 21*i* and 21*e*.

Figure 8:
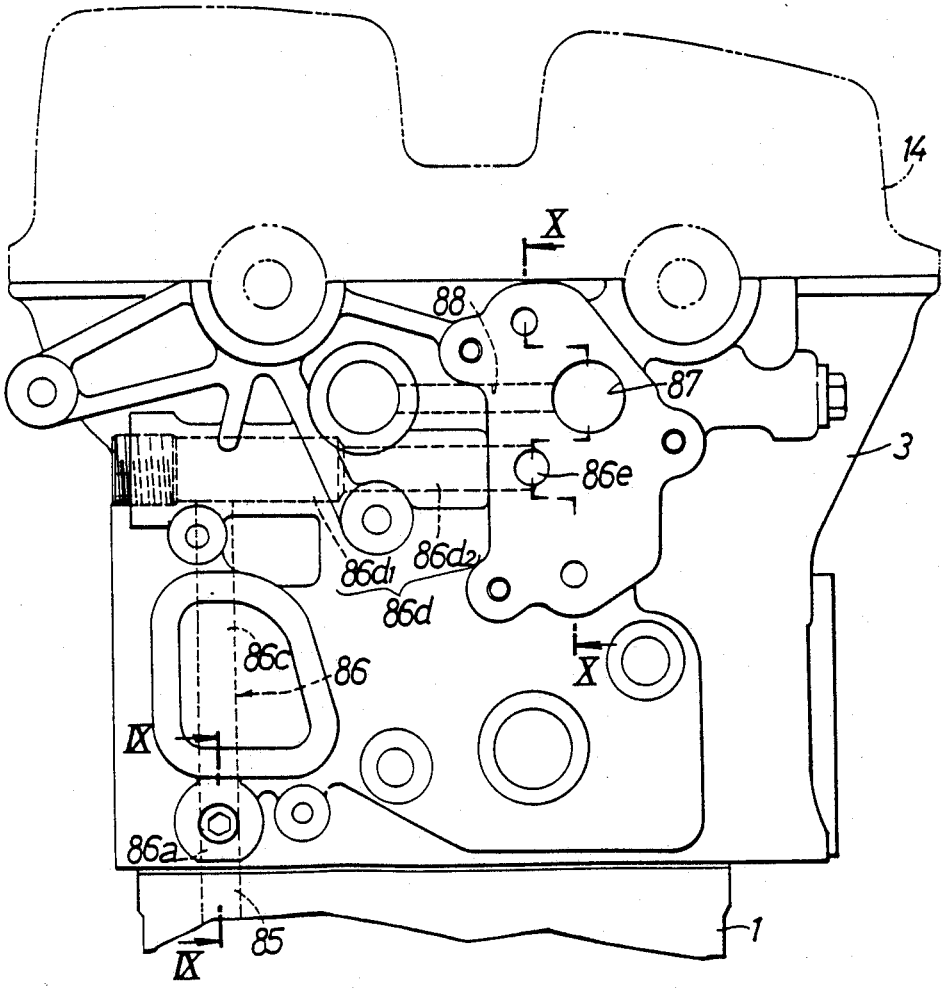
FIG. 8 is a view seen in the direction of the line VIII—VIII of FIG. 2.
Figure 9:
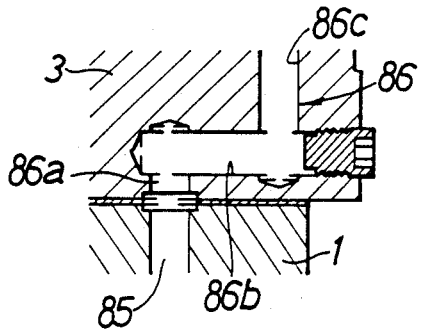
FIG. 9 is a sectional view taken along the line IX—IX of FIG. 8.

Referring to FIGS. 8 and 9, the cylinder block 1 is provided with an oil passage 85 independently of the aforementioned oil passage 77 to extend vertically at a position closer to one end of the block 1 in the cylinder arranging direction. This oil passage 85 is connected to the oil gallery 68 through the filter 70 (see FIG. 7). At the same end as the one end of the cylinder block 1 in the cylinder arranging direction a high speed pressurized oil supply passage 86 is formed in the cylinder head 3 for communication with the oil passage 85 and this passage 86 comprises a passage portion 86*a* communicated with the upper end of the oil passage 85 and extending upwardly a slight distance, a passage portion 86*b* extending from the upper end of the passage portion 86*a* further toward the one end of the cylinder head 3, a passage portion 86*c* extending upwardly from the passage portion 86*b*, a passage portion 86*d* in communication with the upper end of the passage portion 86*c* to extend toward the side of the rocker shaft 22*e* of the exhaust valve side valve operating system 17*e*, and a passage portion 86*e* communicated with the passage portion 86*d* and opening to the one end surface of the cylinder head 3.

Figure 10:
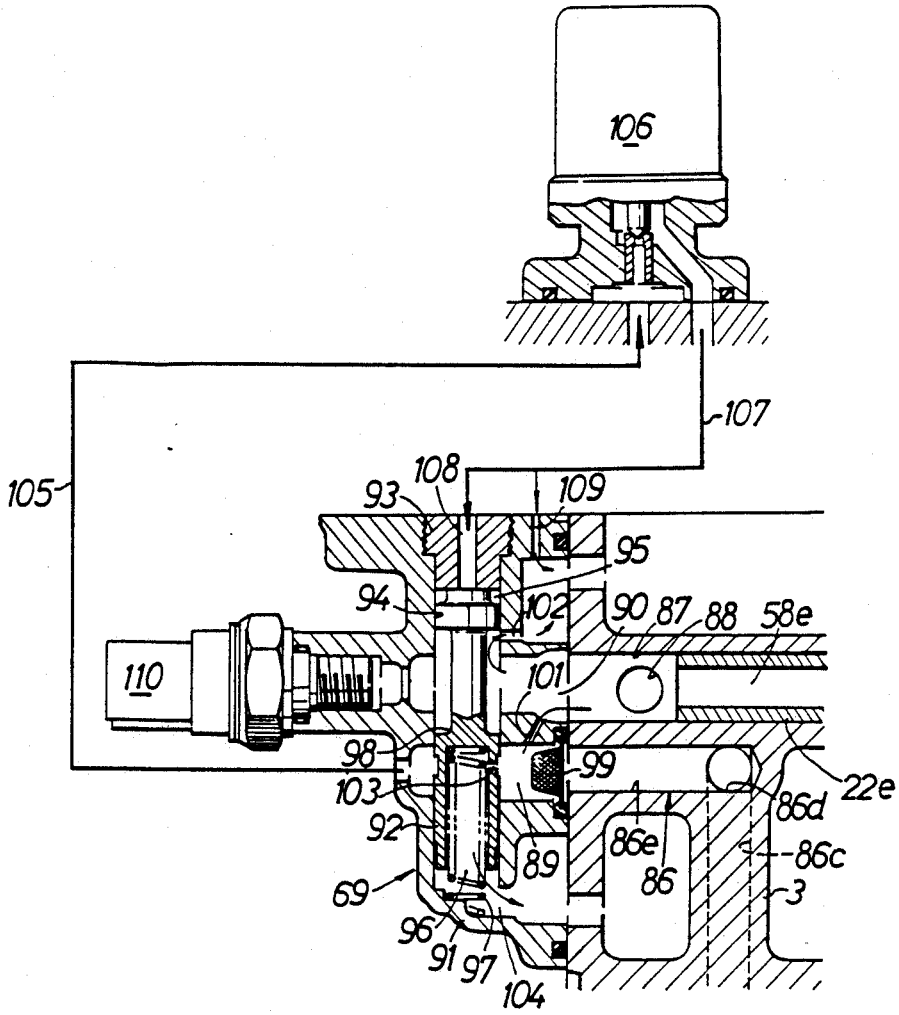
FIG. 10 is an enlarged sectional view taken along the line X—X of FIG. 8, showing the closed state of a switchover valve.

Referring also to FIG. 10, an oil supply port 87 leading to the oil supply passage 58*e* within the rocker shaft 22*e* is bored at that portion of the cylinder head 3 which supports one end of one of the rocker shafts 22*i*, 22*e*, that is, of the exhaust side rocker shaft 22*e*. This oil supply port 87 is opened t the one end surface of the cylinder head 3. A communication passage 88 is further bored in the cylinder head 3 to communicate the oil supply port 87 with the oil supply passage 58*i* within the intake side rocker shaft 22*i*.

The switchover valve 69 is mounted to the one end surface of the cylinder head 3 for switching over the connection and disconnection of the opening of the high speed pressurized oil supply passage 86 to the one end surface of the cylinder head 3, that is, the passage portion 86*e*, with and from the oil supply port 87. The switchover valve 69 comprises a housing 91 mounted to the one end surface of the cylinder head 3 and provided with an inlet port 89 communicating with the passage portion 86*e* as well as an outlet port 90 leading to the oil supply port 87, and a spool valve body 92 slidably fitted within the housing 91 in a manner shiftable between a low pressurized oil supply position (upper position) admitting a low pressurized oil into the oil supply port 87 and a high pressurized oil supply position (lower position) admitting a high pressurized oil into the port 87.

The housing 91 is bored with a cylinder bore 94 having an upper end closed by a cap 93 and the spool valve body 92 is slidably fitted to the cylinder bore 94 to define a hydraulic operation chamber 95 between itself and the cap 93. A spring chamber 96 is defined between the lower part of the housing 91 and the spool valve body 92 to accommodate therein a spring 97 which urges the spool valve body 92 upwardly. Thereby, the spool valve body 92 is normally urged upwardly or toward the low pressurized oil supply position and is caused, upon feeding of a high pressurized oil into the hydraulic operation chamber 95, to move toward the high pressurized oil supply position. The spool valve body 92 is formed with an annular recess portion 98 for permitting communication between the inlet port 89 and the outlet port 90 and when the spool valve body 92 is moved to the upward position as shown in FIG. 10, the spool valve body 92 is in a position cutting off communication between the inlet and outlet ports 89 and 90.

When the housing 91 has been mounted to the end surface of the cylinder head 3, an oil filter 99 is clamped in place between the inlet port 89 and the passage portion 86*e* of the high speed pressurized oil supply passage 86. The housing 91 is further formed with an orifice port 101 for providing a connection between the inlet and outlet ports 89 and 90. Accordingly, even if the spool valve body 92 assumes its closed position, the inlet port 89 and the outlet port 90 are communicated together via the orifice port 101 and the pressurized oil which has been throttled at the orifice port 101 is supplied through the outlet port 90 to the oil supply port 87.

The housing 91 is additionally formed with a bypass port 102 which is placed in communication with the outlet port 90 through the annular recess portion 98 only when the spool valve body 92 is at the closed position and this bypass port 102 communicates with an upper portion within the cylinder head 3. An orifice port 103 is bored through the spool valve body 92 for bringing the inlet port 89 into communication with the spring chamber 96 irrespective of the position of the spool valve body 92. A through hole 104 is formed in the lower part of the housing 91 to communicate the spring chamber 96 with the interior of the cylinder head 3. As a result, any oil flown into the sprig chamber 96 from the orifice port 103 is returned to the interior of the cylinder head 3 through the through hole 104, whereby any dust and dirts which may have been attached to the spring 97 can be taken away therefrom by the oil flow thus preventing such dust and dirts from undesirably affecting the expanding and contracting operations of the spring 97. A conduit 105 is coupled to the housing 91 in a manner to communicate at all times with the inlet port 89 and this conduit 105 is connected to a conduit 107 through the medium of a solenoid valve 106. The conduit 107 is in turn connected to a connection hole 108 formed through the cap 93.

The housing 91 is further provided with a leak jet 109 which communicates with the conduit 107 as well as with the upper portion within the cylinder head 3.

Now assuming that the solenoid valve 106 is actuated and opened for the purpose of moving the spool valve body 92 of the switchover valve 69 from the low pressurized oil supply position to the high pressurized oil supply position, the operation oil within the high speed pressurized oil supply passage 86 is flown into the oil supply passages **58*i* and 58*e* in a moment. This may result in a momentary pressure reduction at a portion within the high speed pressurized oil supply passage 86 immediately before the switchover valve 69. It is arranged in this embodiment, however, in order to avoid such pressure reduction, that the high speed pressurized oil supply passage 86 has a midway portion thereof enlarged in volume sufficient for exhibiting a hydraulic pressure accumulating effect. That is, with reference to FIG. 8 again, the passage portion 86*d* which is bored in the cylinder head 3 to extend almost horizontally comprises an enlarged-diameter portion $86d_1$ communicating with the vertical passage portion 86*c* and a reduced-diameter portion $86d_2$ connected to the enlarged-diameter portion $86d_1$ via a step and the enlarged-diameter portion $86d_1$ is formed to have a sufficient volume. The cross-sectional area of the reduced-diameter portion $86d_2$ is set larger than that of the passage portion 86*c***.

Moreover, a pressure level sensor 110 is equipped on the housing 91 in order to sense the pressure level at the outlet port 90, that is, within the oil supply passages **58*i*, 58*e*. The pressure level sensor 110 is adapted to check whether or not the switchover valve 69** is in normal operation.

Figure 11:
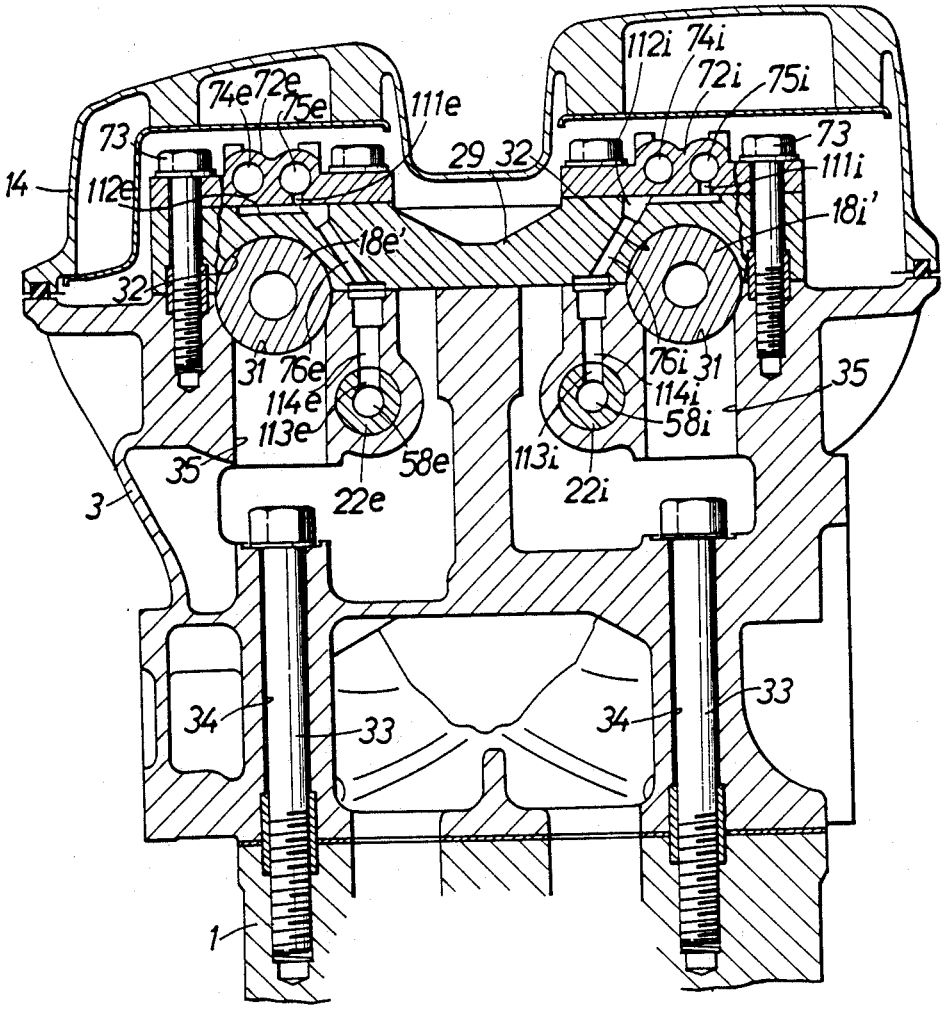
FIG. 11 is a sectional view taken along the line XI—XI of FIG. 2.

As shown in FIG. 11, on the other end side of the cylinder head 3, that is, on the side opposite to the mounted position of the switchover valve 69, communication ports **111*i*, 111*e* which communicate with the high speed lubricant passages 75*i*, 75*e* are formed on the end portions of the passage defining embers 72*i*, 72*e*, respectively, so as to open downwardly of the members 72*i*, 72*e* and a pair of grooves are formed on the upper surface of one cam holder 29 to serve as communication passages 112*i*, 112*e* in communication with the ports 111*i*, 111*e*, respectively. In the meantime, communication ports 113*i*, 113*e* are formed at the end portions of the rocker shafts 22*i*, 22*e* so as to be connected to the oil supply passages 58*i*, 58*e*, respectively. Communication passages 114*i*, 114*e* which are bored in the cylinder head 3 in communication with the respective communication ports 113*i*, 113*e* are connected to the aforementioned communication passages 112*i*, 112*e* through the throttles 76*i*, 76*e* bored in the cam holder 29. Consequently, pressurized oil fed to the oil supply passages 58*i*, 58*e* is supplied to the high speed lubricant passages 75*i*, 75*e* through the throttles 76*i*, 76*e***.

The operation of this illustrated embodiment will be described hereinafter. Lubricating oil is supplied into the low speed lubricant passages **74*i*, 74*e* through the oil passage 77, low speed pressurized oil supply passage 78 and forked oil passage 80 which are disposed independently of the respective connection switchover mechanisms 26*i*, 26*e* so that even when the switchover valve 69 is operated to actuate the connection switchover mechanisms 26*i*, 26*e* with use of a controlled hydraulic pressure, there is always assured a constant level of hydraulic pressure to be supplied to those mechanisms irrespective of the lubricating function and therefore lubricating oil can be supplied under a stabilized pressure to the sliding parts between the low speed cams 19*i*, 19*e*, 20*i*, 20*e* and the drive rocker arms 23*i*, 23*e*, 24*i*, 24*e*, the sliding parts between the high speed cams 21*i*, 21*e* and the free rocker arms 25*i*, 25*e* and to the cam journal portions 18*i'*, 18*e'* of the camshafts 18*i*, 18*e***.

Furthermore, since the oil passage 77, the low speed pressurized oil supply passage 78 and the forked oil passage 80 are arranged at a substantial center position in the direction of arrangement of the cylinders 2, it is assured that loss in flow pressure of the lubricant which may be caused until it reaches respective lubricant injection ports **82*i*, 82*e* and lubricant supply passages 83*i*, 83*e*** can almost be constant thereby to equalize the amount of lubricating oil supplied to the parts in substance.

When it is desired to switch over the operation of the respective connection switchover mechanism **26*i*, 26*e* to render the intake valves 10*i* and the exhaust valves 10*e* operative in the high speed mode, the solenoid valve 106 is opened. Thereby, pressurized oil is fed into the hydraulic operation chamber 95 and the force generated by the pressure prevailing the chamber 95 urges the spool valve body 92 toward the opened position, which admits the pressurized oil into the oil supply passages 58*i*, 58*e* and accordingly into the hydraulic pressure chamber 56. In consequence, the respective connection switchover mechanisms 26*i*, 26*e* are operated to provide a connected state causing the intake valves 10*i* and the exhaust valves 10*e*** to be opened and closed in the high speed operation mode.

The term "high speed operation mode" is used herein to mean that in such a mode at least one of the valve opening period and the amount of lift of the valve has been set larger than that of the "low speed operation mode". On the other hand, the low speed operation mode is meant to include a valve operation stopped condition.

Though, at this moment, a relatively large amount of operation oil is supplied from the high speed pressurized oil supply passage 86 to the oil supply passages **58*i*, 58*e*, the enlarged-diameter portion $86d_1$ of the passage portion 86*d* has a sufficient volume to allow a smooth supply of pressurized oil while preventing generation of a pressure pulsation in the oil supplied to the passages 58*i*, 58*e*, There is also a possibility that the operation oil may be expanded to generate air at the tie of flowing into the enlarged-diameter portion $86d_1$ from the passage portion 86c, however, the step is disposed at a connection between the enlarged-diameter portion $86d_1$ and the reduced-diameter portion $86d_2$ so that any air generated is avoided from flowing toward the switchover valve 69 side to the utmost, thus avoiding occurrence of air trapping at the switchover valve 69**.

The lubricating oil which has been supplied to the high speed lubricant passages 75i, 75e in his high speed operation mode is injected through the lubricant injection ports 84i, 84e thus providing a sufficient lubrication to the sliding parts between the high seed cams 21i, 21e and the free rocker arms 25i, 25e which are subjected to a particularly large surface pressure.

In a normal connected operation of the connection switchover mechanism 26, the detection pin 124 of the detection means 123 is in abutment against the shaft portion 53a of the regulating pin 53 and therefore a low voltage is inputted to the control circuit 128. Accordingly, if a high voltage is inputted to the control circuit 128 when the solenoid valve 106 has been opened and the connection switchover mechanism 26i should assume a connected state, then it can be judged that an erroneous operation is effected in the connection switchover mechanism 26i.

It should be noted that when the position of the switchover valve 69 is switched over from the low speed operation mode to the high speed operation mode, there is some time lag due to the throttles 76i, 76e until the pressure in the high speed lubricant passages 75i, 75e increases to a predetermined level and therefore some time delay occurs until the lubricating oil is injected from the lubricant injection ports 84i, 84e. However, owing to the provision of the lubricant injection ports 82i, 82e leading from the low speed lubricant passages 74i, 74e also at positions corresponding to the sliding parts between the high speed cams 21i, 21e and the free rocker arms 25i, 25e, even with some time delay in lubricant injection through the ports 84i, 84e, there is no fear that lubrication becomes insufficient at the sliding parts between the high speed cams 21i, 21e and the free rocker arms 25i, 25e. Even if, in a condition where the respective pins 51, 52 and 53 of the connection switchover mechanism 26i, 26e have been locked, the switchover valve 69 has been closed in order to establish the low speed operation mode, though the surface pressure at the sliding parts between the high speed cams 21i, 21e and the free rocker arms 25i, 25e increases to a high level like the high speed operation mode, it is ensured that a sufficient lubrication is still carried out to the slide parts between the high speed cams 21i, 21e and the free rocker arms 25i, 25e since the lubricating oil is injected thereto from the lubricant injection ports 82i, 82e which communicate with the low speed lubricant passages 74i, 74e.

When the opening and closing operations of the intake valves 10i and the exhaust valves 10e are switched over from the high speed operation mode to the low speed operation mode, the solenoid valve 106 is closed. Upon closure of this solenoid valve 106, the pressurized oil within the conduit 107 is released outside through the leak jet 109 to swiftly leak the pressurized oil in the hydraulic operation chamber 95 and in response thereto the switchover valve 69 is closed without delay. When the switchover valve 69 assumes a closed state, the pressurized oil within the oil supply passages 58i, 58e is released to the interior of the cylinder head 3 whereby the pressure in the oil supply passages 58i, 58e, that is, in the hydraulic pressure chamber 56 o each connection switchover mechanism 26i, 26e promptly falls down to a low level, leading to an improved responsiveness in the switchover operation from the high speed operation mode to the low speed operation mode.

When the connection switchover mechanism 26i has been brought to a normal connection release condition, the detection pin 124 of the detection means 123 is separated from the shaft portion 53a and a high level of voltage is inputted to the control circuit 128. Accordingly, it can be judged by watching the level of voltage input to the control circuit 128 whether or not the connection switchover mechanism 26i is in a normally operating condition.

Also in a lubricant supply system of the mentioned type, one low speed pressurized oil supply passage 78 and one high speed pressurized oil supply passage 86 will be sufficient for the cylinder head 3 so that working of the cylinder head 3 can be extremely easy. Moreover, since the switchover valve 69 is mounted to one end surface of the cylinder head 3, its mounting structure is simple. Furthermore, since the oil supply passages 58i, 58e are use commonly for the oil supply to the connection switchover mechanisms 26i, 26e as well as to the high speed lubricant passages 75i, 75e, there is no need for separate use of an oil supply conduit nor for separate provision of an oil supply passage on the cylinder head 3. Thereby, oil supply is performed efficiently while avoiding an increase in the number of components and an increase in the manufacturing steps.

What is claimed is:

1. A valve operating system of an internal combustion engine, comprising a plurality of valve operating means disposed for driving at least one engine valve for opening and closing operations thereof, a connection means which is movable for connecting said valve operating means integrally, a driving means for driving said connection means, and a detection means for detecting a moved position of said connection means.

2. A system according to claim 1, wherein said engine valve is capable of selectively assuming a first operation mode wherein said valve is driven by said valve operating means which have been integrally connected with each other by said connection means and a second operation mode wherein a connection between the valve operating means established by said connection means has been released and said engine valve is driven by a part of said valve operating means.

3. A system according to claim 1 or 2, wherein said valve operating means are rocker arms.

4. A system according to claim 3, wherein said driving means is hydraulic pressure which is introduced into a hydraulic pressure chamber provided in one of said rocker arms in order to urge said connection means.

5. A system according t claim 1, wherein said connection means and said detection mans are arranged coaxially with each other in a direction of movement of said connection means.

6. A system according to claim 1 or 5, wherein said detection means is connected to an electric power supply and this detection means comes into electrical contact with said connection means at certain moved position of said connection means to detect an operation of said connection means.

7. A valve operating system of an internal combustion engine, including a plurality of rocker arms carried on a stationary rocker shaft for opening and closing an engine valve, and a connection switchover mechanism for the rocker arms having a plurality of pins disposed to abut against each other in a coaxial arrangement, said pins including a switchover pin exposed at a surface of one axial end thereof to a hydraulic pressure chamber and movable between a position connecting adjacent rocker arms and another position releasing such connection between the rocker arms and a regulating pin with a return spring interposed between the regulating pin and one rocker arm, the return spring exerting a spring force to the regulating pin so as to urge the latter toward said one axial end, wherein said regulating pin of the connection switchover mechanism is provided coaxially with a shaft portion which extends through one rocker arm on which the regulating pin is disposed and on which a detection means is provided for detecting an axial position of said shaft portion

* * * * *